US005481445A

United States Patent [19]

Sitzema et al.

[11] Patent Number: 5,481,445

[45] Date of Patent: Jan. 2, 1996

[54] TRANSFLECTION REFLECTOR HAVING CONTROLLED REFLECTED AND TRANSMITTED LIGHT DISTRIBUTION

[75] Inventors: Ronald L. Sitzema, Ellsworth; Dale A. Troppman, Charlevoix; Gregg A. Motter, Midland, all of Mich.

[73] Assignees: Lexalite International Corp., Charlevoix; Dow Chemical Company, Midland, both of Mich.

[21] Appl. No.: 196,303

[22] Filed: Feb. 15, 1994

[51] Int. Cl.[6] ..... F21V 7/22

[52] U.S. Cl. ..... 362/308; 362/327; 362/329; 362/333

[58] Field of Search ..... 359/584, 586, 359/587, 589; 362/304, 305, 307, 308, 327, 329, 331, 333, 334

[56] References Cited

U.S. PATENT DOCUMENTS

| | | | |
|---|---|---|---|
| 1,368,674 | 2/1921 | Wohlauer | 362/307 |
| 1,947,344 | 2/1934 | Lang | 362/304 |
| 3,395,273 | 7/1968 | Welty | 362/334 |
| 3,712,980 | 1/1973 | Norton | 359/589 |
| 4,072,856 | 2/1978 | Eligehausen | 362/343 |
| 4,434,455 | 2/1984 | Merritt | 362/307 |
| 4,719,548 | 1/1988 | Orosz | 362/334 |
| 4,839,781 | 6/1989 | Barnes et al. | 362/299 |
| 5,046,818 | 9/1991 | Barnes | 359/527 |
| 5,122,905 | 6/1992 | Wheatley et al. | 359/586 |
| 5,122,906 | 6/1992 | Wheatley | 359/586 |
| 5,126,880 | 6/1992 | Wheatley et al. | 359/587 |
| 5,143,446 | 9/1992 | Barnes et al. | 362/293 |

*Primary Examiner*—Ira S. Lazarus
*Assistant Examiner*—Alan B. Cariaso
*Attorney, Agent, or Firm*—Mason, Kolehmainen, Rathburn & Wyss

[57] ABSTRACT

A transflection reflector includes a body for simultaneously reflecting and transmitting light rays. The body is formed by a plurality of layers of a polymeric reflective material and has reflected rays at each interface between adjacent ones of the multiple layers. The body is both selectively configured and positioned relative to a light source for a predetermined distribution of reflected and transmitted rays.

4 Claims, 3 Drawing Sheets

TRANSFLECTION REFLECTOR HAVING CONTROLLED REFLECTED AND TRANSMITTED LIGHT DISTRIBUTION

BACKGROUND OF THE INVENTION

1. Field of the Invention

The present invention relates generally to reflectors, and more particularly to a transflection reflector comprised of a multiple layer polymeric body.

2. Description of the Prior Art

Various arrangements are known for reflectors. Typically, reflectors are manufactured in metals such as steel or aluminum, or of a glass or plastic; and then these materials are painted, plated, vacuum metalized, or a vapor or chemical deposition is used to place a thin metal onto the surface of the reflector. When a clear transparent metalized reflector is used, the deposition aluminum coverage often is random so that the reflector appearance is non-uniform and performance is generally unpredictable.

A traditional type of ornamental roadway luminaire with a metal or a metalized plastic reflector causes the total direct illumination otherwise directed above the 90 degrees horizontal plane to be reflected into the lower body portion of the luminaire and eliminates nearly all the uplight component. While this type of reflector decreases the number of luminaires required to illuminate a roadway or pathway, the outline of the luminaire is significantly reduced and the illumination is concentrated into a smaller area of the luminaire, causing an increased apparent brightness in the luminaire. If an uplight component is required in a street light, these reflectors must be perforated to allow light leakage into the uplight zone above 90 degrees horizontal.

Another alternative reflector is provided by using precisely cut internal reflection optics onto a reflector contour. This type of reflector must be manufactured in transparent, clear plastic or glass if it is to be efficient and effective; but it has limitations as to the size of the prism being machined into the tool or mold. In these reflectors the uplight component is a by-product of the losses within the individual prisms. Changes to the uplight component can only be manipulated by an expensive re-machining of the tool that forms the reflector, or tinting the substrate material or the addition of a translucent cover over the exterior of the reflector.

For example, U.S. Pat. No. 4,839,781 issued to Josh T. Barnes and Ronald J. Sitzema Jun. 13, 1989, discloses a reflector device for use with a variety of lighting fixtures and light sources. The reflector has a predetermined profile and predefined sectional zones. Each sectional zone has predetermined light distribution characteristics. The reflector provides a predetermined light distribution characteristic by a vertical movement of an illuminating lamp source.

U.S. Pat. No. 5,046,818 issued to Josh T. Barnes Sep. 10, 1991, discloses an optical system for traffic signal devices including a reflector and a lens.

While the prismatic reflectors disclosed by the above-identified patents provide improvements over prior art arrangements, it is desirable to provide a transflection reflector that eliminates the need for internal reflection prisms.

SUMMARY OF THE INVENTION

Among the principal objects of the present invention are to provide a transflection reflector overcoming many of the disadvantages of known reflectors.

In brief, the objects and advantages of the present invention are achieved by a transflection reflector including a body for simultaneously reflecting and transmitting light rays. The body is formed by a plurality of layers of a polymeric reflective material and has reflected rays at each interface between adjacent ones of the multiple layers and each adjacent layer having a different index of refraction. The body is both selectively configured and positioned relative to a light source for a predetermined distribution of reflected and transmitted rays.

BRIEF DESCRIPTION OF THE DRAWING

The present invention together with the above and other objects and advantages may best be understood from the following detailed description of the embodiment of the invention illustrated in the drawing, wherein.

DETAILED DESCRIPTION OF THE PREFERRED EMBODIMENT

Figure 1:
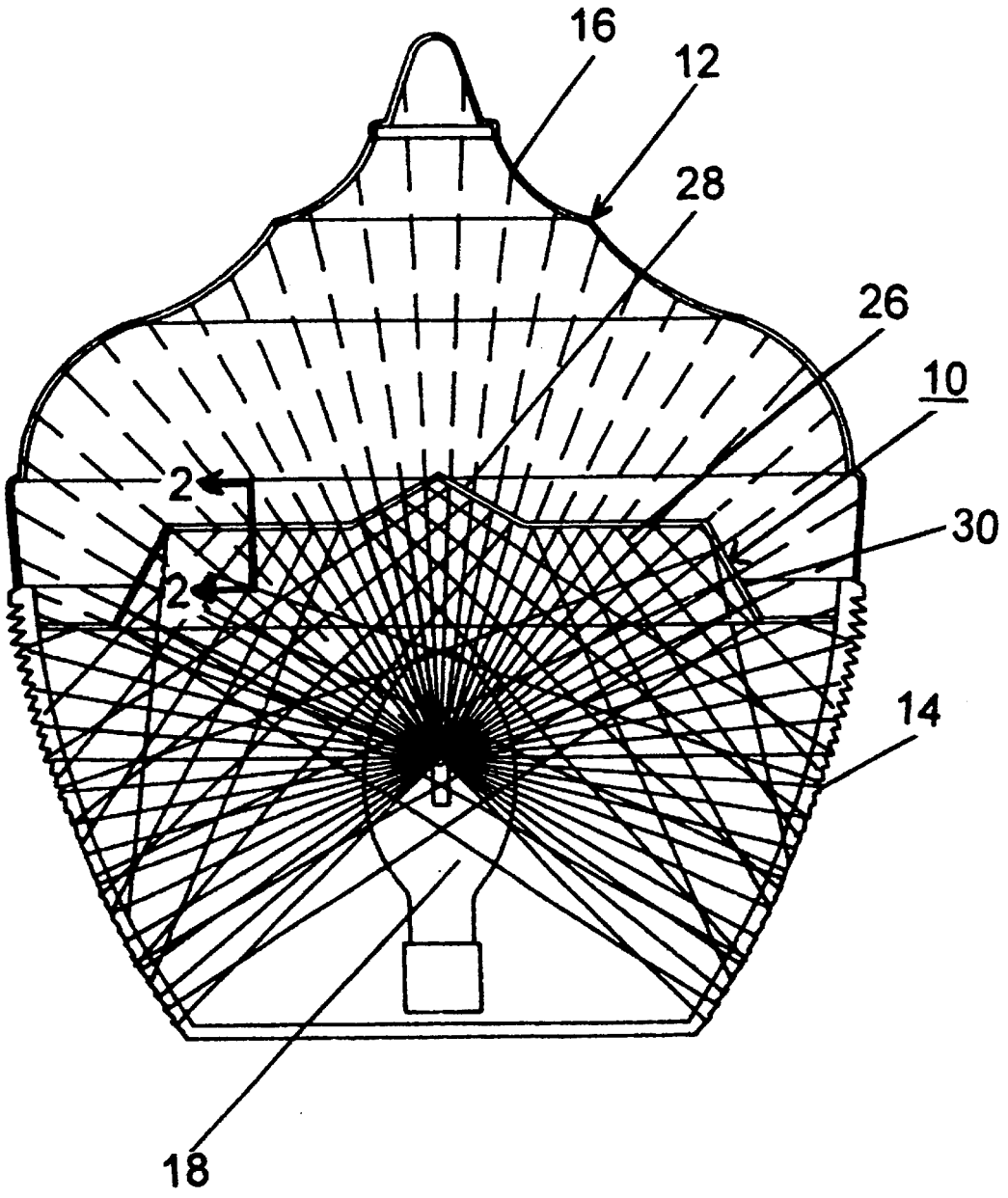
FIG. 1 is a transflection reflector in accordance with the present invention shown used with a traditional type of ornamental roadway luminaire.

Referring now to the drawing, in FIG. 1 there is illustrated a transflection reflector designated as a whole by the reference character 10 and arranged in accordance with principles of the present invention. Transflection reflector 10 is comprised of a multiple layer polymeric body, which reflects and transmits light simultaneously, and can be fabricated by various methods into practical optical reflector contours. The reflected and transmitted light can be infinitely varied through the composition of the sheet material.

Reflector 10 is formed of multiple layered polymeric reflective material for use in a lighting fixture or roadway luminaire. The material may be commonly issued in various thicknesses, transmissions and reflectance, thereby, capable of reflecting and selectively transmitting a wide range of incident light that intercepts its surface. Using this property, an ornamental or roadway luminaire can be designed to use both the reflective and transmission properties or transflection of the material for lighting applications.

Having reference initially to FIG. 1, the transflection reflector 10 is shown used with a traditional type of ornamental roadway luminaire 12 comprised of a refractor 14 for its lower body and an acorn-shaped light transmitting top 16 for its upper body. The luminaires 12 whether glass or plastic, are limited in their use of direct illumination from a lamp 18 because the luminaire without an internal reflector would typically emit up to 35 percent of the available lamp lumens above the 90 degree horizontal plane. The energy would be uncontrolled and essentially wasted, contributing to sky glow and increasing the number of luminaires required to illuminate a roadway or a pathway of recommended illumination levels.

Using transflection reflector 10 of the invention, it is possible to create variable and tailored uplight light distribution, specifically to define the outline of the acorn-shaped top 16 by using transflection properties of the polymeric material, while providing controlled downlight distribution.

Figure 2:
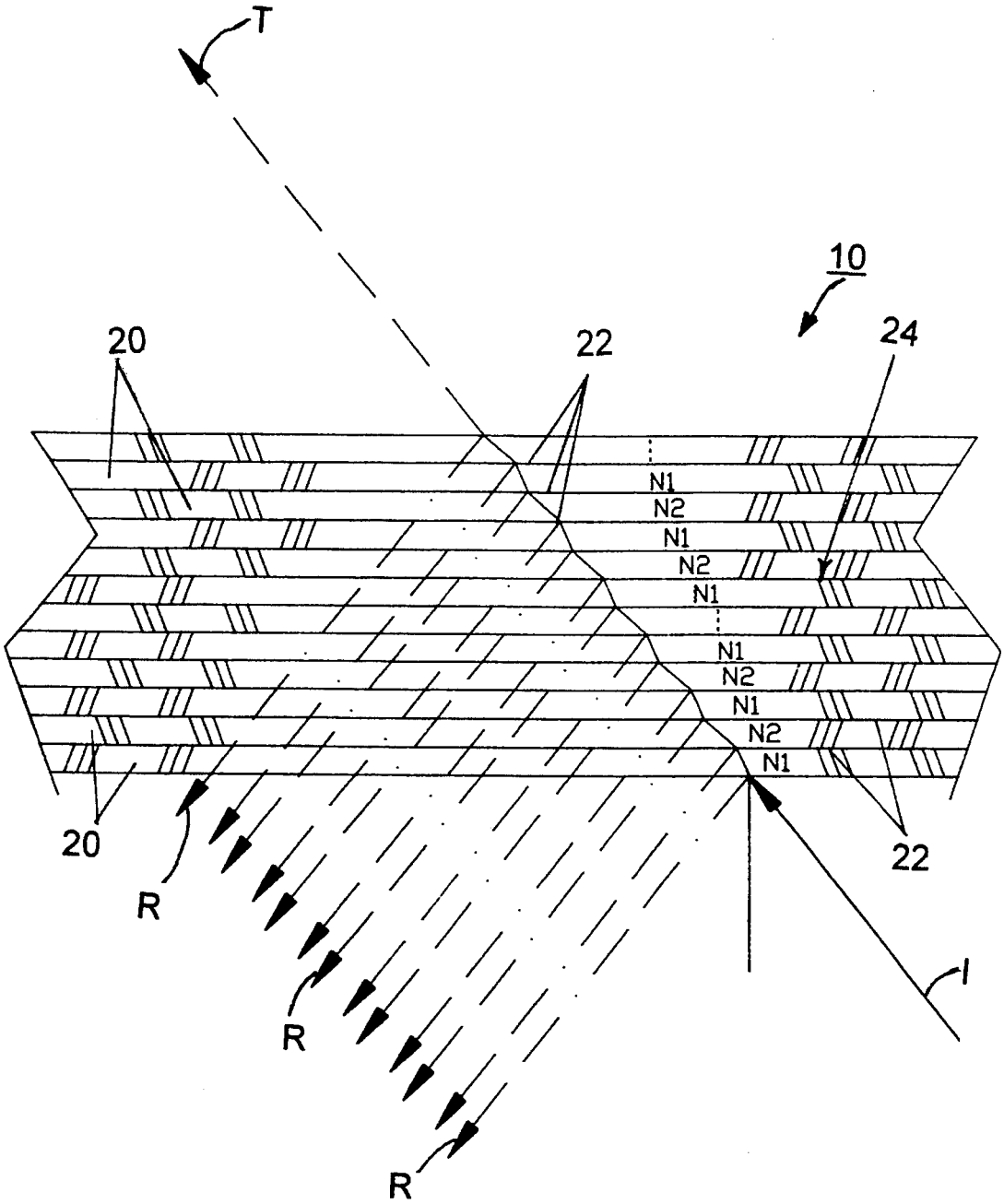
FIG. 2 is a fragmentary cross-sectional view taken along the line 2—2 of FIGS. 1 and 3 illustrating typical reflected rays at each material layer interface.
Figure 3:
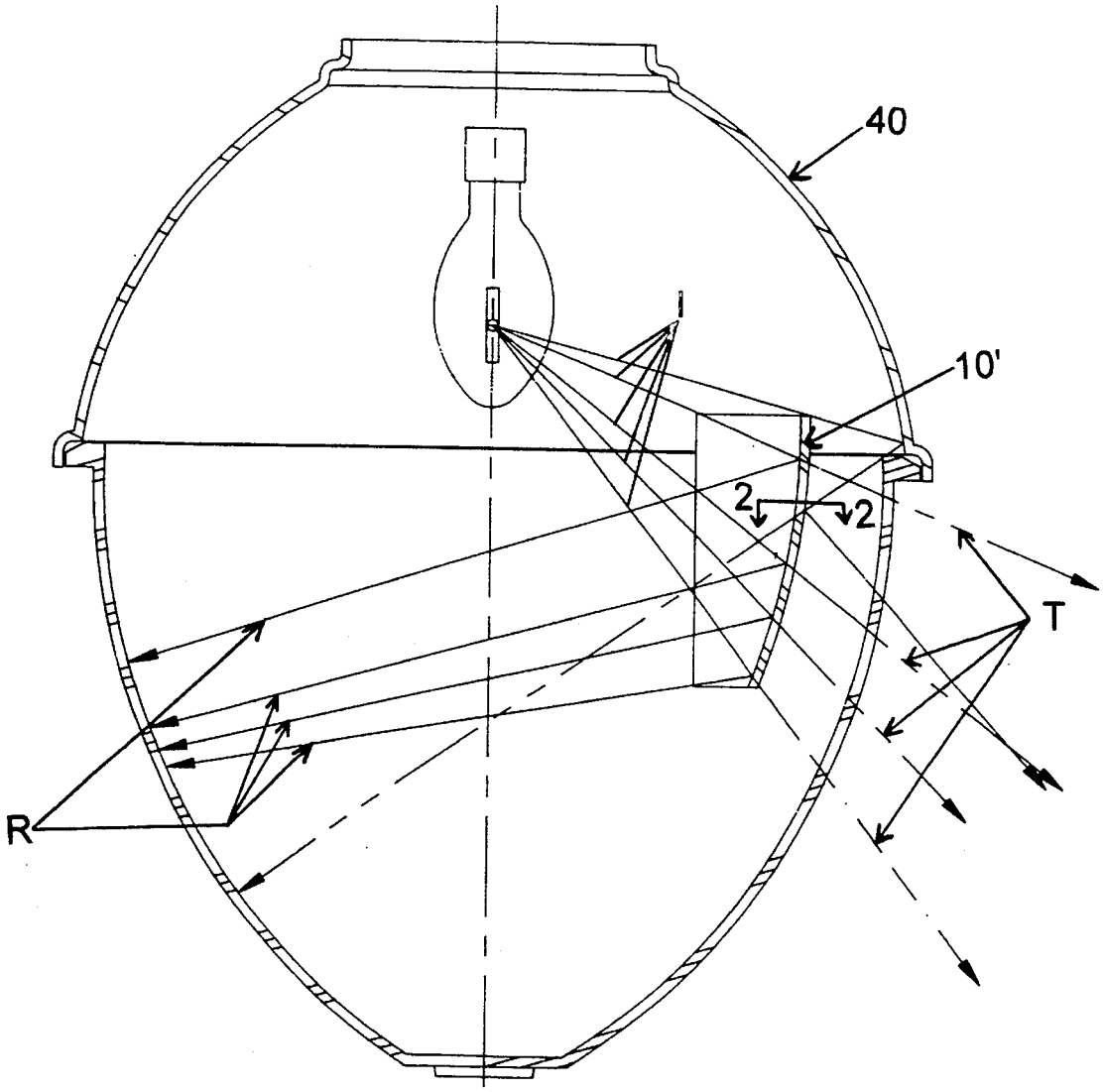
FIG. 3 is another transflection reflector in accordance with the present invention shown used with a different traditional type of street luminaire.

Referring also to FIG. 2, there is shown a fragmentary cross-sectional view taken along the line 2—2 of FIGS. 1 and 3 of the transflection reflector 10 and 10' including a plurality of polymeric reflective material layers 20. For an incoming incident ray designated by I, FIG. 2 illustrates typical reflected rays designated by R at each polymeric reflective material layer interface generally designated by 22 included in a polymeric body 24 defined by a selected number of the polymeric reflective material layers 20, where there is a different index of refraction between adjacent layers. A remaining transmitted light ray is indicated by T. As shown in FIG. 2, the polymeric reflective body 24 provides a unique characteristic in that substantial amounts of reflected light rays R of an equal and opposite angle of direction to the incoming rays are slightly displaced by the multiple individual polymeric layers 20 that make up the polymeric body. The individual ray is broken down into a series of smaller, less intense rays all leaving the reflection interfaces, equal and opposite, to the incoming ray I. This characteristic creates a specular bar of illumination from an individual ray, but still retains the characteristic of the individual ray in that relatively little diffusion occurs. These existence rays tend to create an increased beam pattern, governed by the number of layers and individual material thicknesses of the reflector 10, 10', and the angle of the incident ray entering at the material interfaces.

This characteristic creates a spatially spread array of light rays having less concentrated illumination in each ray and tends to increase the apparent lamp image, thereby reducing glare from the reflector surface. This in turn provides a more uniform illumination from the surface of transflection reflector 10 with less damaging concentrations of energy onto the interior of the refractor surface 14, as compared with a metal reflector. Since there is negligible absorption in the optical polymers used to create the polymeric body 24, the transmitted uplight component has an intensity of the incident intensity less the reflected intensity.

One example of the polymeric body 24 includes 2609 layers equalling 67–73 percent specular reflectivity and 1300 layers equalling 50–58 percent specular reflectivity. Another example of the polymeric body 24 includes 5200 layers equalling 79–87 percent specular reflectivity.

The multiple layer polymeric body 24 advantageously is formed and has optical characteristics of the materials disclosed in U.S. Pat. Nos. 5,122,905, 5,122,906 and 5,126,880, assigned to Dow Chemical Company. The disclosures of the above-identified patents are incorporated herein by reference.

Transflection reflector 10 has a substantially flat upper section 26 for reflecting lamp illumination into the lower ⅔ of the luminaire refractor 14 with a peaked section 28 directly above the lamp 18 for reflecting lamp illumination into the lower ⅓ of the luminaire refractor 14. Transflection reflector 10 has a sidewall 30 sloped at 59° when measured from the Nadir for reflecting lamp illumination into the lower ⅔ of the luminaire refractor 14. Sidewall 30 can be a smooth surface as shown. Alternatively, a fluted surface can be provided for sidewall 30. The illumination from the 59° sidewall 30 is reflected at angles, when measured from Nadir, of 66°–75° vertical into the lower sidewall of refractor 14. The illumination from the upper flat section 26 is reflected at angles, when measured from Nadir, of 22°–44° vertical into the lower sidewall of refractor 14. The peaked section 28 is sloped at 61° when measured from Nadir. The illumination from the upper peaked section 28 is reflected at angles, when measured from Nadir, of 30°–56° vertical into the lower sidewall of refractor 14.

A predetermined percentage of the lamp illumination that intercepts the upper section 26 is reflected into the lower ⅔ of the luminaire refractor 14, for example in a range selectively provided between 25–75 percent. Transflection reflector 10 is configured to reflect light rays outward and away from the lamp 18 into the lower sidewall of refractor 14 to avoid premature failure of the lamp.

Referring now to FIG. 3, there is shown a street luminaire 40 which requires house side shielding using vertical lamp orientation and an alternatively configured transflection reflector 10'. As shown, the multiple layer polymeric transflection reflector 10' can be used to receive incoming rays I and reflect the majority of the light rays R toward a roadway in these types of traditional street luminaires 40 while permitting 10–40 percent of the light rays T to pass through the shield and reduce the shadowing on the walkway of a house side. A metallic or metalized plastic reflector would simply cut off all light toward the house side and create a dark shadow on the walkway.

It should be obvious that other roadway reflector shapes and distributions could be developed in which a horizontal oriented lamp is incorporated into a reflector configuration made of this material, which could provide both roadway and house side distributions through redirected downlight, while providing some prescribed uplight contribution for facade, landscape or park lighting.

While the invention has been described with reference to details of the illustrated embodiment, these details are not intended to limit the scope of the invention as defined in the appended claims.

We claim:

1. In combination, a transflection reflector and an ornamental roadway luminaire including an upper body and a lower body, said ornamental roadway luminair including a refractor for said lower body and an acorn-shaped top for said upper body and a light source generally centrally disposed within said lower body refractor, said transflection reflector comprising:

a transflection reflector body for simultaneously reflecting and transmitting light rays, said body being formed by a plurality of layers of a polymeric reflective material with adjacent layers having a different index of refraction and having reflected rays at each interface between adjacent ones of said multiple layers; and said transflection reflector body being selectively positioned above the light source and below said acorn-shaped top, said transflection reflector body having a substantially flat upper section for reflecting light rays downwardly into a lower ⅔ portion of said lower body refractor and an upper peaked section disposed above the light source for reflecting light rays downwardly into a lower ⅓ portion of said lower body refractor.

2. In combination, a transflection reflector and an ornamental roadway luminaire as recited in claim 1 wherein said transflection reflector body provides a spatially spread array of light rays having less concentrated illumination in each ray and increases an apparent lamp image, thereby reducing glare from the reflector surface.

3. A transflection reflector as recited in claim 1 wherein said transflection reflector body is selectively configured to provide reflection of intercepted light rays in a range between 25 percent to 75 percent.

4. A transflection reflector as recited in claim 1 wherein said plurality of layers is in a range between 500 and 5500 layers.

* * * * *